US010427925B2

(12) United States Patent
Xu

(10) Patent No.: US 10,427,925 B2
(45) Date of Patent: Oct. 1, 2019

(54) VEHICLE WITH A ROTARY CONTROL BOX AND AERIAL WORK PLATFORM

(71) Applicant: ZHEJIANG DINGLI MACHINERY CO., LTD., Zhejiang (CN)

(72) Inventor: Shugen Xu, Zhejiang (CN)

(73) Assignee: ZHEJIANG DINGLI MACHINERY CO., LTD., Deqing, Zhejiang (CN)

( * ) Notice: Subject to any disclaimer, the term of this patent is extended or adjusted under 35 U.S.C. 154(b) by 211 days.

(21) Appl. No.: 15/629,395

(22) Filed: Jun. 21, 2017

(65) Prior Publication Data

US 2018/0057320 A1 Mar. 1, 2018

(30) Foreign Application Priority Data

Aug. 24, 2016 (CN) ..... 2016 1 07188877

(51) Int. Cl.
*B66F 11/04* (2006.01)
*B66C 13/56* (2006.01)
(Continued)

(52) U.S. Cl.
CPC ..... *B66F 11/046* (2013.01); *B66C 13/44* (2013.01); *B66C 13/56* (2013.01); *B66F 9/0759* (2013.01);
(Continued)

(58) Field of Classification Search
CPC ..... B66C 13/44; B66F 9/0759
See application file for complete search history.

(56) References Cited

U.S. PATENT DOCUMENTS 3,396,814 A * 8/1968 Garnett ..... B66F 11/046 182/2.11
3,516,514 A * 6/1970 Dold ..... B66F 11/044 182/148
(Continued)

FOREIGN PATENT DOCUMENTS

CA 3007572 A1 * 6/2017 ..... B66F 9/07527
CA 3024190 A1 * 11/2017 ..... B66F 11/046
(Continued)

OTHER PUBLICATIONS

Espacenet English abstract of CN 202729728 U.
Espacenet English abstract of CN 102963458 A.

*Primary Examiner* — Marcus Menezes
(74) *Attorney, Agent, or Firm* — Ladas & Parry LLP

(57) ABSTRACT

The present invention relates to the field of engineering mechanics and more particularly, relates to an engineering work vehicle, and most particularly, relates to a vehicle with a rotary control box and aerial working platform. The vehicle with a rotary control box includes: a vehicle frame, a driving system disposed on the vehicle frame, and a control box; the control box is disposed at a lateral side of the vehicle frame in a rotary manner; and the control box is electrically connected with the driving system. embodiments of current invention makes it possible to manipulate with ease the aerial work platform to perform corresponding motions by an operator standing on the ground and, this kind of manipulation is quick and accurate. In addition, more convenience and human-friendliness is brought. At the same time, life time of relevant components of the aerial work platform is extended, and maintenance and repair cost is further reduced.

9 Claims, 12 Drawing Sheets

(51) Int. Cl.
*B66F 9/075* (2006.01)
*B66C 13/44* (2006.01)
*B66F 17/00* (2006.01)

(52) U.S. Cl.
CPC ..... *B66F 11/04* (2013.01); *B66F 11/044* (2013.01); *B66F 17/006* (2013.01)

(56) References Cited

U.S. PATENT DOCUMENTS

| | | | | |
|---|---|---|---|---|
| 6,000,502 | A * | 12/1999 | Leasor | B62D 1/02 180/401 |
| 6,401,368 | B1 * | 6/2002 | McLeod | E02F 3/4135 37/142.5 |
| 10,071,678 | B2 * | 9/2018 | Luminet | B66F 11/046 |
| 2004/0173404 | A1 * | 9/2004 | Kobel | A62B 1/22 182/2.1 |
| 2004/0262078 | A1 * | 12/2004 | Bailey | B66F 11/046 182/2.1 |
| 2009/0145871 | A1 * | 6/2009 | Bond | B66C 13/44 212/285 |
| 2009/0218173 | A1 * | 9/2009 | Beeson | B66F 11/046 187/234 |
| 2015/0284219 | A1 * | 10/2015 | McConnell | B60P 3/12 414/680 |
| 2017/0137270 | A1 * | 5/2017 | Shugen | B66F 11/04 |
| 2017/0137271 | A1 * | 5/2017 | Shugen | B66F 11/04 |
| 2018/0050893 | A1 * | 2/2018 | Jeffries | B66F 11/044 |

FOREIGN PATENT DOCUMENTS

| | | | |
|---|---|---|---|
| CN | 202729728 | U | 2/2013 |
| CN | 102963458 | A | 3/2013 |

* cited by examiner

VEHICLE WITH A ROTARY CONTROL BOX AND AERIAL WORK PLATFORM

FIELD OF THE INVENTION

The present invention relates to field of engineering mechanics and more particularly, relates to an engineering work vehicle, and most particularly, relates to a vehicle with a rotary control box and aerial work platform.

BACKGROUND OF THE INVENTION

Aerial work platform is an advanced aerial working mechanical device, and is capable of significantly improving efficiency, safety, and comfort of operators at height, and is also capable of reducing labor. Accordingly, it is widely employed in developed countries. This aerial work platform is also extensively used in China in many fields such as urban street lamp maintenance, tree trimming or the like. With rapid development of Chinese economy, aerial work platform is increasingly required in many situations such as engineering construction, industry installation, equipment repair, workshop maintenance, ship manufacture, electric power, municipal construction, airport, communications, city park, and transportation.

A prior art aerial work platform has a control device disposed on an operation platform or in a cab of a vehicle. In case of arranging the control device on the operation platform, control is realized by an operator standing on the operation platform who manipulates vertical movement and other action of the operation platform through a control device. The operator and control device move for example up and down together with the operation platform. In this situation, it is hard for the operator to control the aerial work platform on the ground. Instead, the operator must stand on the operation platform to control the entire aerial work platform, and this result in inconvenience. In latter case, the operator locates in the cab to manipulate vertical movement and other actions of the operation platform through the control device. In this situation, the operator must stay in the cab which is a closed or semi-closed space. This will obstruct sight of the operator or form a blind area, thus causing failure for the operator to accurately manipulate the aerial work platform. To realize intended control purpose, the operator may be required to repeat the same actions upon the aerial work platform for many times. For example, to raise the operation platform up to a certain height, the operation platform must be raised or lowered many times. Furthermore, the operator has to frequently move his head out of the cab to check visually the height of the operation platform or another person outside of the cab may be necessary to coordinate the operator inside the cab. As a result, this kind of operation platform control is with less efficiency. Moreover, this kind of control is greatly restricted and inconvenient.

Of course, with rapid development of the society and progress of technology, for some arm-type aerial work platform, a control device is laterally mounted on a turret of the vehicle such that the operator standing on the ground is able to perform operations upon the control device. However, as the control device is fixedly mounted on the turret and in turn it rotates together with the turret, following rotation of the turret, the operator must also adjust his location accordingly to effectively control the device, thereby resulting in inconvenience for the operator.

Moreover, all above control means feature securing the control device to a corresponding location. When the control device is in an idle condition, it is hard to hide the control device for protective purpose. This always exposed control device is easily subject to dust and aging. Furthermore, when not in use, the control device also occupies a large area and this causes inconvenience to the operator and appearance is not good.

Therefore, there is a need for an improved control device construction and/or mounting means and corresponding aerial work platform to overcome drawbacks mentioned above.

SUMMARY OF THE INVENTION

An object of the present invention is to address above problems and provide a vehicle with rotary control box and aerial work platform. This makes it possible to manipulate with ease the aerial work platform to perform corresponding motions by an operator standing on the ground and, this kind of manipulation is quick and accurate.

To realize this object, an embodiment of the invention provides a vehicle with rotary control box, including: a vehicle frame, a driving system disposed on the vehicle frame, and a control box. The control box is disposed at a lateral side of the vehicle frame in a rotary manner. The control box is electrically connected with the driving system.

Specifically, the control box is hinged to a lateral side of the vehicle frame.

Preferably, the control box is hinged to a lateral side of a base of the vehicle frame.

Furthermore, a casing is disposed at a lateral side of the base. A turning opening is defined at a lateral side of the casing for turning the control box into and out of the casing. An edge of the control box is hinged to a corresponding edge of the turning opening.

Preferably, the edge of the control box is hinged to an upper edge of the turning opening.

Furthermore, a locking device is provided on both of the control box and casing for locking the control box when turning into the casing.

Furthermore, a hinging element for hinging the control box and casing together is provided with a supporting locking device for supporting and locating the control box.

Correspondingly, an embodiment of the present invention further provides an aerial work platform including a vehicle with rotary control box as mentioned above, a telescopic transmission component pivotally mounted on the vehicle, and an operation platform disposed on a distal end of the telescopic transmission component.

Furthermore, a control device is provided on the operation platform for being electrically connected with the driving system of the vehicle.

Compared with prior art techniques, embodiments of the present invention may bring the following good effects:

In present invention, as the control box is disposed at a lateral side of the vehicle frame in a rotary manner and is electrically connected with the driving system, an operator standing on the ground is able to act upon the control box such that the aerial work platform can perform certain motions. As such, manipulation is realized at the same time the operator monitors motions of the aerial work platform. For instance, the operator may operate the control box to raise the operation platform while at the same time watches height of the operation platform in real time. In this situation, there is no need for the operator to stand on the operation platform and control motions of the aerial work platform through related control device, thereby bringing convenience and safety of operation. Moreover, it is not required for the operator to move his head frequently out of the cab to watch motions of the aerial work platform. There is also no need for another person out of the cab to coordinate with the operator inside the cab. Furthermore, sight of the operator is not restricted and accordingly, repeatedly control of the aerial work platform to perform the same motions is avoided, thus convenient, rapid and accurate control being realized.

Preferably, a casing is disposed at a lateral side of the base. A turning opening is defined at a lateral side of the casing for turning the control box into and out of the casing. An edge of the control box is hinged to a corresponding edge of the turning opening. Consequently, in case the aerial work platform is manipulated by an operator standing on the ground and through the control box, the control box may be turned out of the casing and then be operated by the operator to realize certain controls to the aerial work platform. Therefore, this kind of control is convenient and safe. When there is no need to operate the control box by the operator on the ground (that is, when the control box is not in use), the control box may be turned into the casing, thereby reducing space occupied by the same box without causing inconvenience to the operator and not having adverse influence on appearance of the entire aerial work platform. This further shields the control box from dust and collision with the operator or other equipment, and accordingly, lifespan of the control box is extended, and maintenance and repair cost is also reduced. In addition, as the control box is disposed at a lateral side of the base in a rotary manner, this avoids extremely lower position of the control box on the lateral side of the base (normally this is because the base is low). This also avoids vertical arrangement of a control panel of the control box, which would otherwise cause inconvenience to the operator. According to some embodiments of the invention, the control box is able to be turned out of the casing when to be used. At this time, the control panel of the control box is horizontal or almost horizontal such that the panel is below the eyes of the operator and can be accessed with ease by hands of the operator. Therefore, the operator is able to see various buttons conveniently and then press down these buttons.

Correspondingly, according to some embodiments of the invention, a locking device for realizing lock of the control box when turned into the casing and a supporting locking device for supporting and locating the control box are provided. When the control box is turned into the casing, it will be locked inside the casing by the locking device manually or automatically. During process of turning the control box out of the casing, the control box may be locked by the locking device at a predefined position at which the operator is able to manipulate the control box with ease. Therefore, the structure mentioned above maintains the control box stably at various conditions. Furthermore, convenience of operation of the aerial work platform is also improved.

In addition, a control device is provided on the operation platform for being electrically connected with the driving system of the vehicle. This facilitates the operator standing on the operation platform to operate the aerial work platform through the control device, this further leading to convenience of operation of the aerial work platform.

Therefore, embodiments of current invention makes it possible to manipulate with ease the aerial work platform to perform corresponding motions by an operator standing on the ground and, this kind of manipulation is quick and accurate. In addition, more convenience and human-friendliness is brought. At the same time, life time of relevant components of the aerial work platform is extended, and maintenance and repair cost is further reduced.

DETAILED DESCRIPTION OF THE INVENTION

Figure 1:
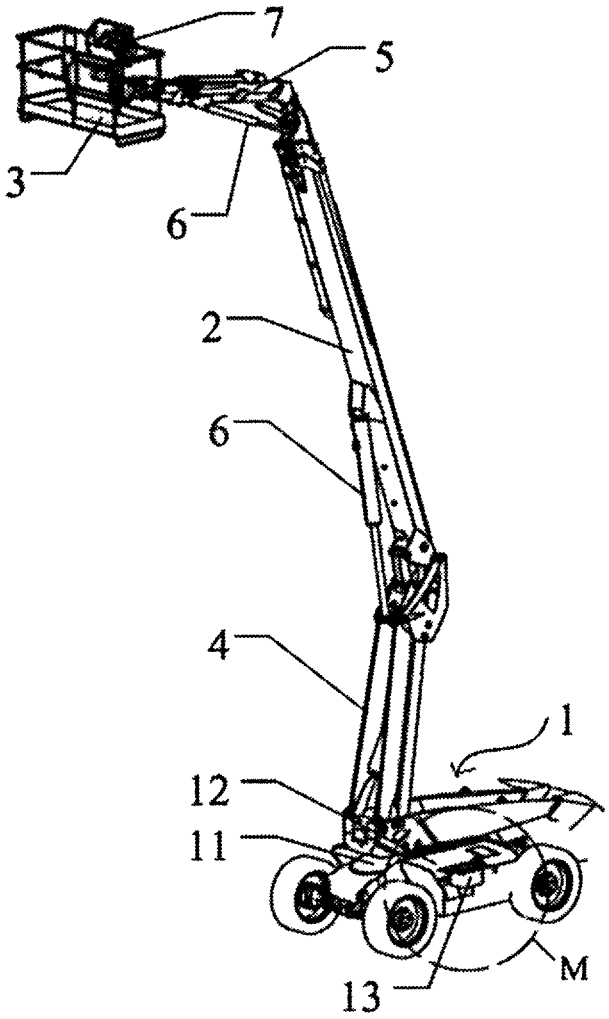
FIG. 1 shows a schematic view of an aerial work platform in accordance with a typical embodiment of the invention.
Figure 2:
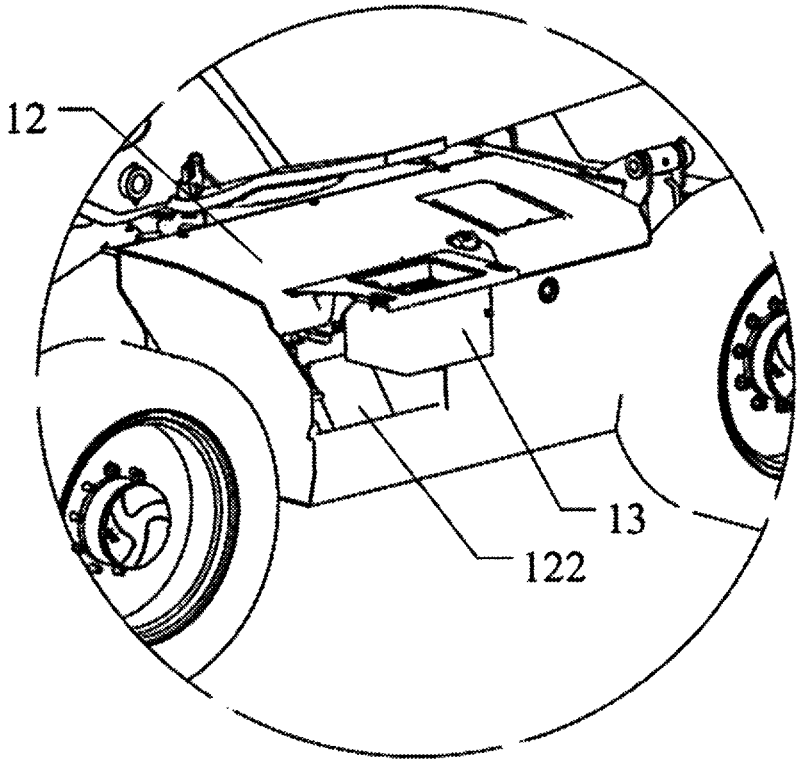
FIG. 2 shows a partially enlarged view of portion M of FIG. 1.
Figure 3:
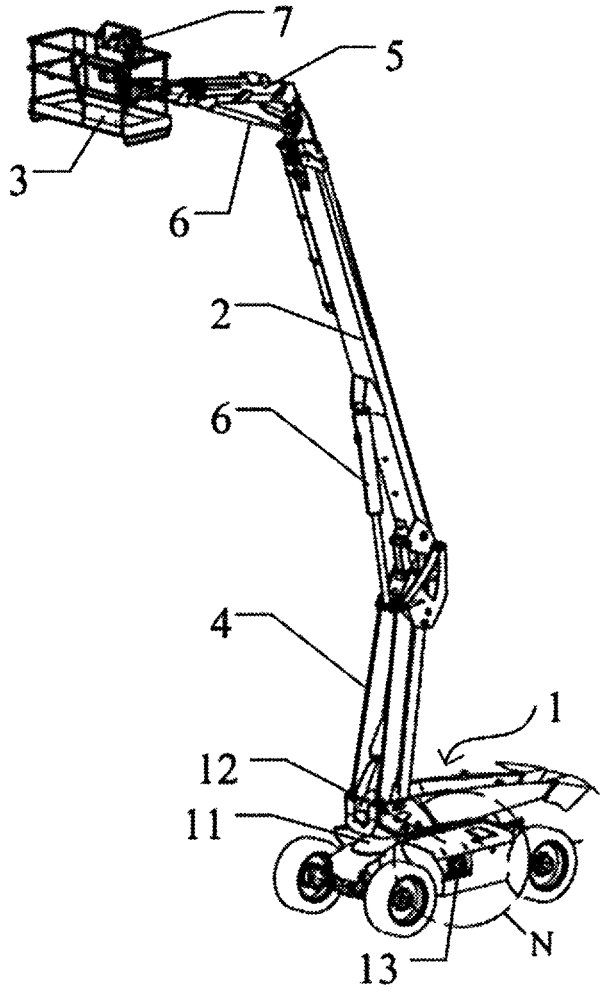
FIG. 3 illustrates another view of the aerial work platform of FIG. 1.
Figure 4:
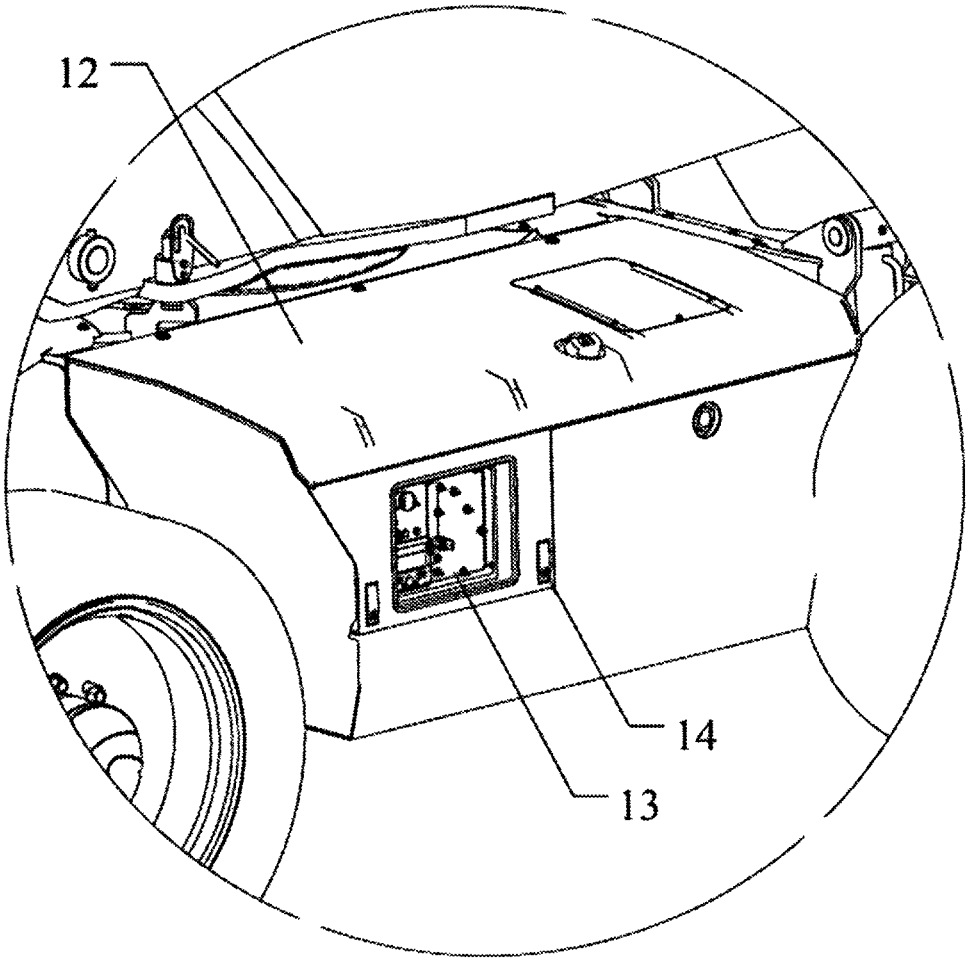
FIG. 4 shows a partially enlarged view of portion N of FIG. 3.
Figure 5:
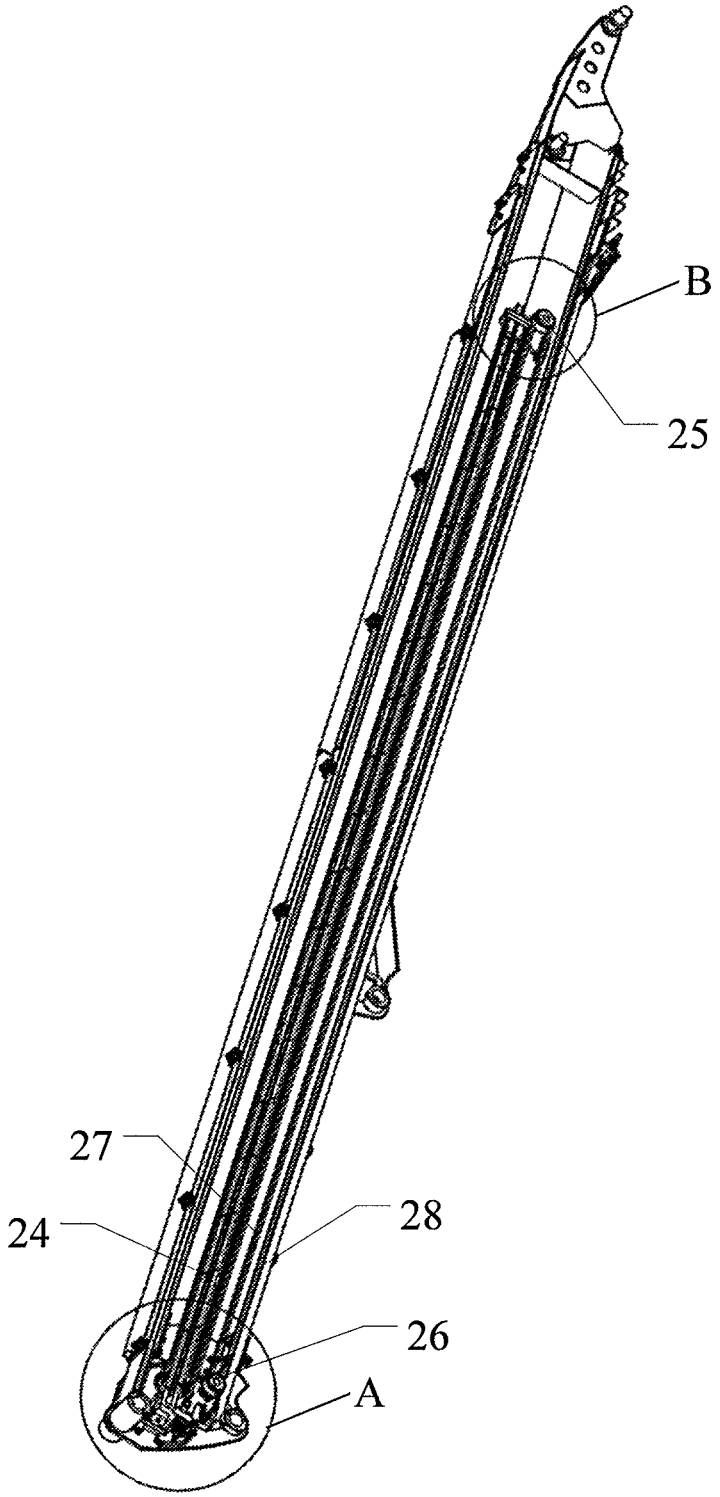
FIG. 5 shows a schematic view of a telescopic transmission component of the aerial work platform of FIG. 1.
Figure 6:
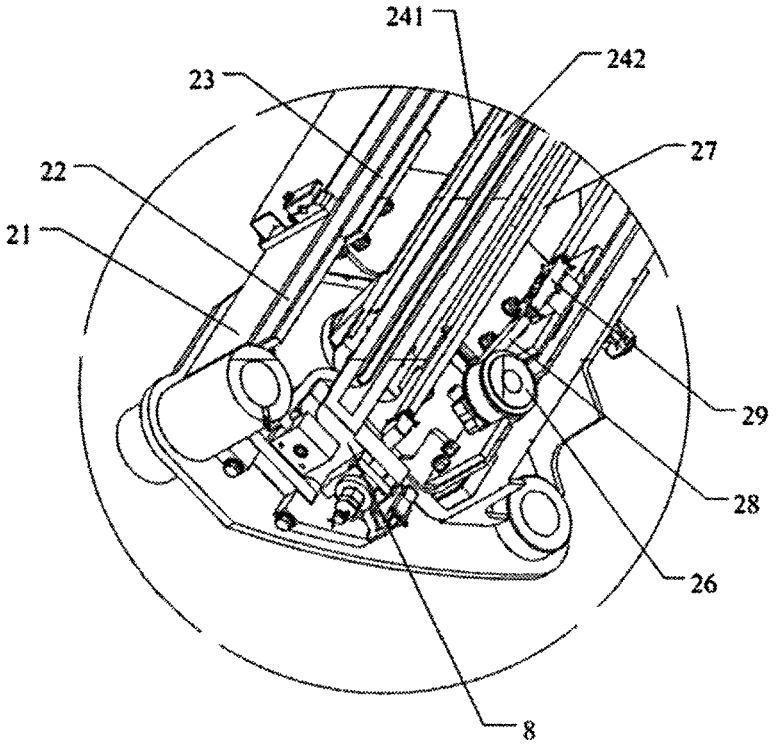
FIG. 6 shows a partially enlarged view of portion A of FIG. 5.
Figure 7:
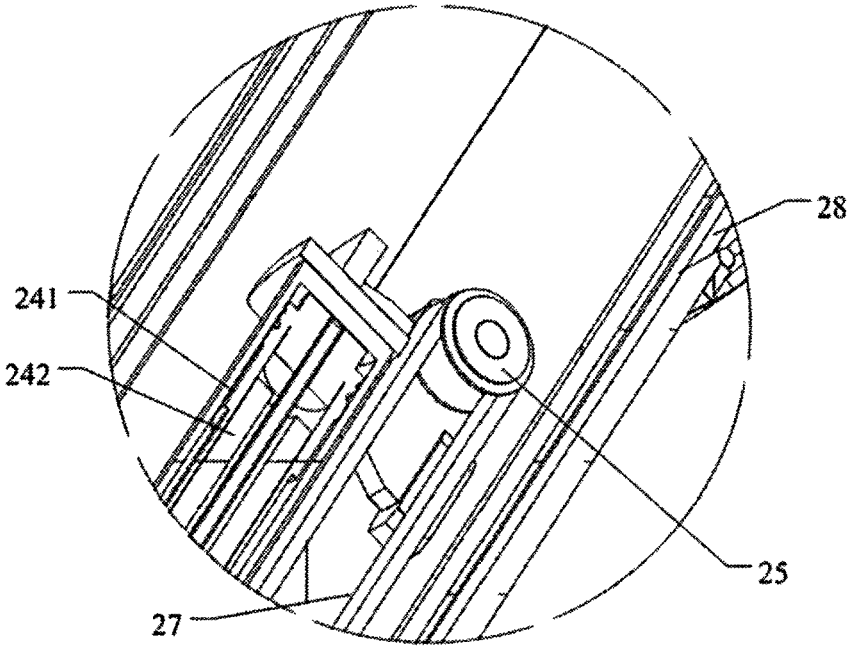
FIG. 7 shows a partially enlarged view of portion B of FIG. 5.

The present invention will be further described below with reference to accompanied drawings and exemplary embodiments. Here, identical numerals represent the identical components. In addition, detailed description of prior art will be omitted if it is unnecessary for illustration of the features of the present invention.

FIGS. 1-13 show a typical embodiment of an aerial work platform of the present invention. The aerial work platform includes a vehicle 1 with a rotary control box, a telescopic transmission component 2 pivotally installed on the vehicle 1 and an operation platform 3 connected to a distal end of the telescopic transmission component 2.

Here, the vehicle 1 includes a vehicle frame 11, a driving system disposed on the vehicle frame 11, and a control box 13 electrically connected to the driving system. The control box 13 is disposed at a lateral side of the vehicle frame 11 in a rotary manner.

It is noted that the driving system includes a driving mechanism, a transmission mechanism, a control system, and a wheel assembly. The control box 13 is also electrically connected with the control system.

Preferably, a casing 12 is disposed at a lateral side of a base of the vehicle frame 11. The control box 13 is disposed at a lateral side of the casing 12. Specifically, a turning opening 122 is defined at a lateral side of the casing 12 for turning the control box 13 into and out of the casing 12. An upper edge of control box 13 (See orientation of the control box in FIGS. 1-4) is hinged to an upper edge of the turning opening 122. The height of the control box 13 relative to the ground is such designed that, when the control box 13 is rotated out of the casing 12 through the turning opening 122, an operator standing on the ground will be able to comfortably get access to the control box 13.

In case the aerial work platform is manipulated by an operator standing on the ground and through the control box 13, the control box 13 may be turned out of the casing 12 and then be operated by the operator to realize certain controls to the aerial work platform. This kind of manipulation is convenient and safe. When there is no need to operate the control box 13 by the operator on the ground (that is, when the control box 13 is not in use), the control box 13 may be turned into the turning opening 122 of the casing 12, thereby reducing space occupied by the same box without causing inconvenience to the operator and not having adverse influence on appearance of the entire aerial work platform. This further shields the control box from dust and collision with the operator or other equipment, and accordingly, lifespan of the control box is extended, and maintenance and repair cost is also reduced.

In addition, when the control box 13 is turned into the casing 12 through the turning opening 122, it will be locked inside the casing 12 by a locking device 14. Partial structure of the locking device 14 is disposed on the control box 13, while corresponding partial structure thereof is disposed on the casing 12.

When the control box 13 is turned into the casing 12, it will be locked inside the casing 12 by the locking device 14 manually or automatically.

Furthermore, a hinging element for hinging the control box 13 and casing 12 together is provided with a supporting locking device (not shown) for supporting and locating the control box 13.

During process of turning the control box 13 out of the casing 12, the control box 13 may be locked by the locking device at a predefined position at which the operator is able to manipulate the control box with ease.

In addition, the control box 13 is disposed at a lateral side of the casing 12. As another embodiment, the control box 13 may also be directly disposed at a lateral side of the vehicle frame 11. Preferably, an upper edge of the control box 13 is hinged to an upper edge of the turning opening 122. The control box 13 and turning opening 122 may also be hinged together at other locations. For example, a right edge of the control box 13 may be hinged to a corresponding right edge of the turning opening 122 (Referring to orientation of FIGS. 1-4).

Preferably, a control device 7 is provided on the operation platform 3 for being electrically connected with the driving system of the vehicle 1. Concretely, the control device 7 is electrically coupled with a control system of the driving system. This facilitates the operator on the operation platform 3 to manipulate the control device 7 such that the aerial work platform will perform related motions, thereby helping the operator select different control manner based on different demand. For example, when the operator stands on the ground, he may select the control box 13 to drive the aerial work platform to perform motions. When the operator is inside the operation platform 3, he can choose the control device 7 to drive the aerial work platform to perform motions. This further improves operation convenience of the aerial work platform.

Reference is made to FIGS. 1-13 illustrating a typical embodiment of a telescopic transmission component of the aerial work platform of the invention. The telescopic transmission component 2 includes a base arm 21, a second arm 22, a third arm, a telescopic cylinder 24, a rope-expanding chain 27, and a rope-retracting chain 28.

Figure 8:
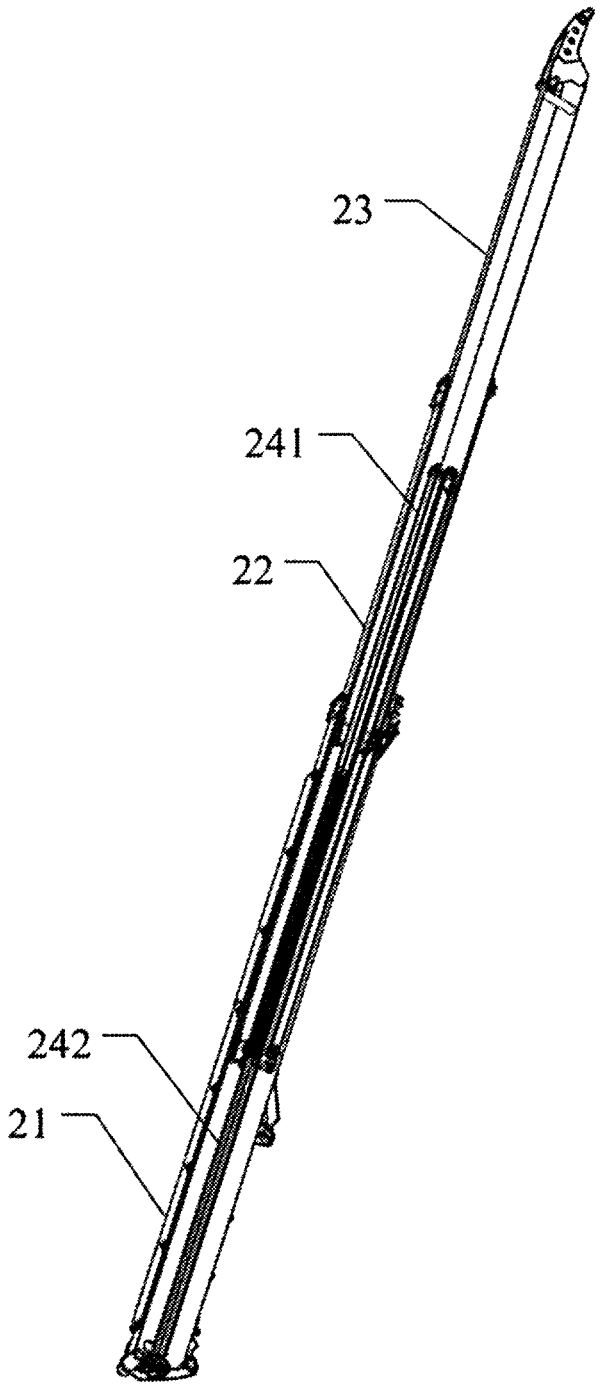
FIG. 8 shows a view of the telescopic transmission component of FIG. 5 in an expanded configuration.

The second arm 22 is inserted into the base arm 21 and is able to move out of the base arm 21 (See an upper portion of FIG. 8). The third arm 23 is inserted into the second arm 22 and is capable of coming out of an extension end of the same (See an upper portion of FIG. 8).

The telescopic cylinder 24 includes a cylinder barrel 241 secured onto the second arm 22 and a telescopic rod 242 inserted into the barrel 241. The telescopic rod 242 has a hollow arrangement 247 communicating with a cavity of the cylinder barrel 241. An oil guiding tube 245 is provided into the hollow arrangement 247 of the telescopic rod 242, and the extension end of the telescopic rod 242 is secured onto the base arm 21 (See a lower portion of FIG. 10). Preferably, an end surface of the extension end of the telescopic rod 242 is fixed to the base arm 21 through a mounting plate 8. A connection portion is provided on the cylinder barrel 241 at a location adjacent to the extension end of the telescopic rod 242 for securing the barrel 241 to the second arm 22. The connection portion may in the form of an axle hole. That is, the cylinder barrel 241 may be mounted on the second arm 22 by inserting a pin into said axle hole. Of course, the connection portion of the barrel 241 may also be designed to locate at other positions of the barrel 241, for example at a middle position Moreover, a first sprocket wheel 25 is provided on the telescopic cylinder 24, a second sprocket wheel 26 is provided on the second arm 22, and the second sprocket wheel 26 is closer to the extension end of the cylinder barrel 241 than does the first sprocket wheel 25. One end of the rope-expanding chain 27 is attached onto the base arm 21, while the other end thereof runs around the first sprocket wheel 25 and then is attached onto the third arm 23. In other words, the two ends of the rope-expanding chain 27 are both located below the first sprocket wheel 25 (See orientation of figures). One end of the rope-retracting chain 28 is attached onto the third arm 23, while the other end thereof runs around the second sprocket wheel 26 and then is attached onto the base arm 21. In other words, the two ends of the rope-retracting chain 28 are both located above the second sprocket wheel 26 (See orientation of figures). Preferably, the first sprocket wheel 25 is located on a cylinder head, which cylinder head is located at one end away from an extension end, of the telescopic cylinder 24. The second sprocket wheel 26 is located on the second arm 22 at a location adjacent to the extension end of the telescopic rod 242. By this manner, the first and second sprocket wheels 25 and 26 are capable of being positioned above and below the cylinder barrel 241 (See orientation of figures). This ensures stable movement of the cylinder barrel 241 and accordingly, it also ensures stable rotation and telescopic motion of relevant components. Of course, the first and second sprocket wheels 25 and 26 may also be positioned at other suitable locations. For instance, the first sprocket wheel 25 may be located at a middle area of the cylinder barrel 241, and the second sprocket wheel 26 may be placed on the second arm 22 at a location close to a middle portion of the cylinder barrel 241.

Figure 9:
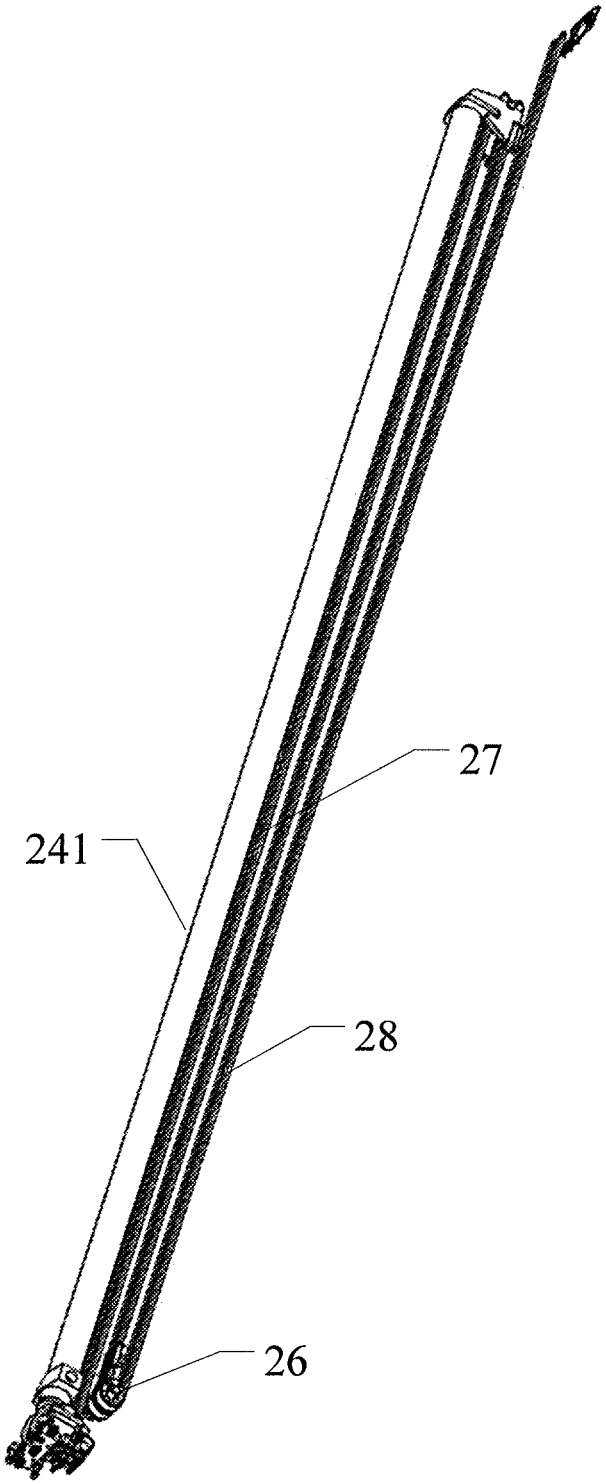
FIG. 9 denotes a structural view of internal major transmission members of the telescopic transmission component of FIG. 5, the major transmission members including a first sprocket wheel, a second sprocket wheel, a rope-expanding chain, a rope-retracting chain, and a retractable cylinder.
Figure 10:
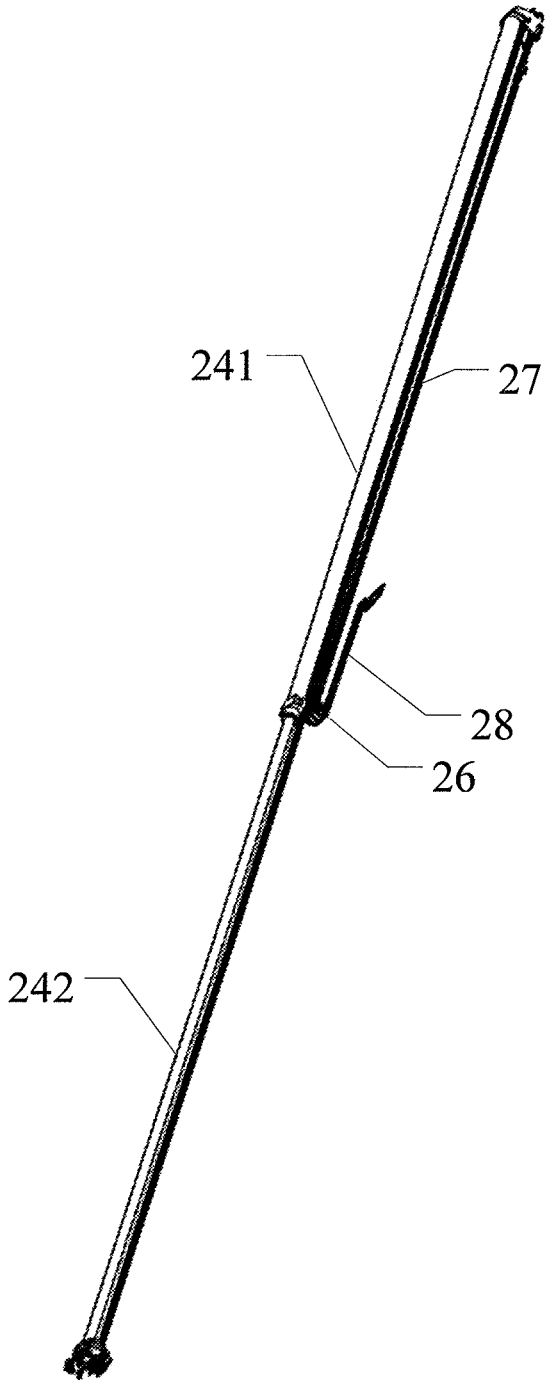
FIG. 10 shows a schematic view of internal major transmission members of the telescopic transmission component of FIG. 5.
Figure 11:
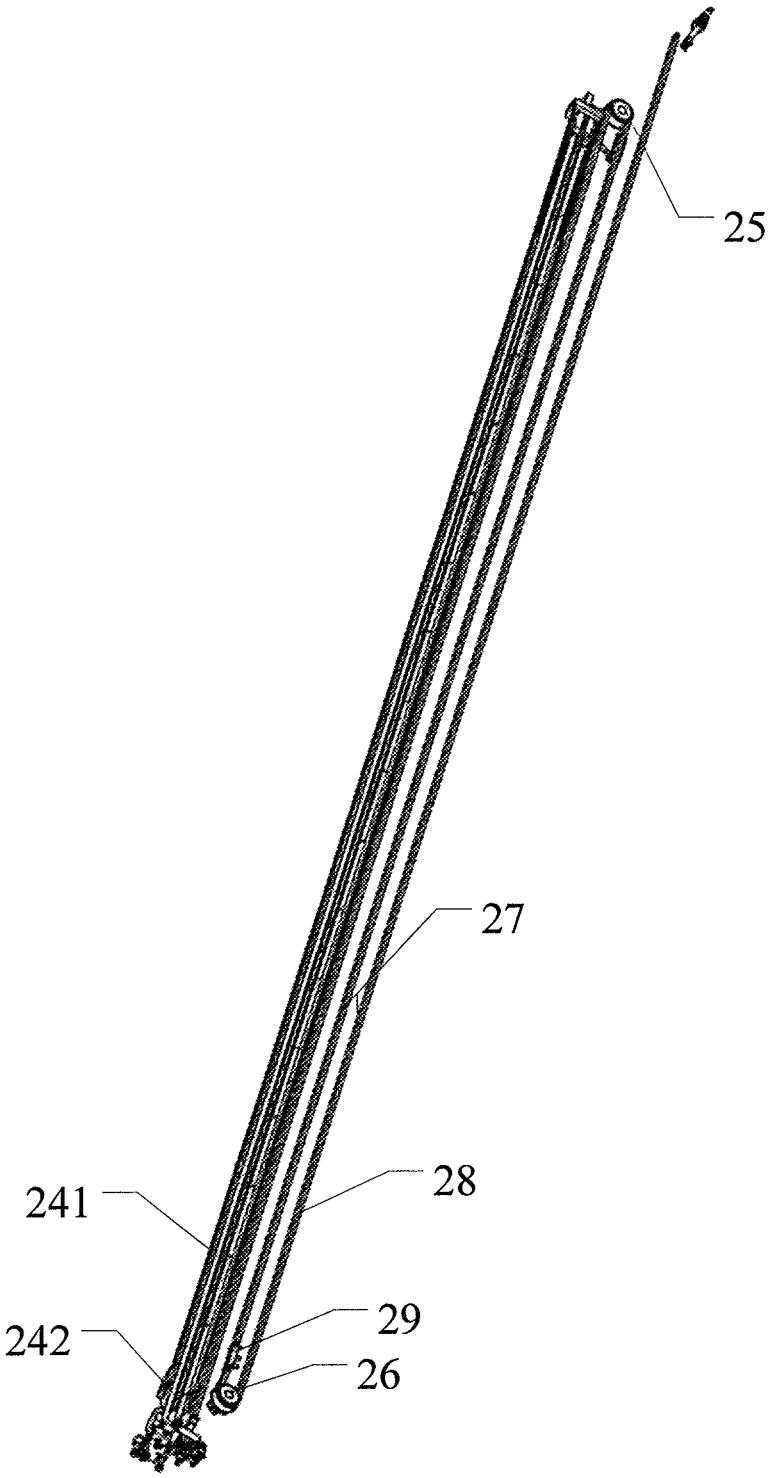
FIG. 11 shows a schematic view of internal major transmission members of the telescopic transmission component of FIG. 5.
Figure 12:
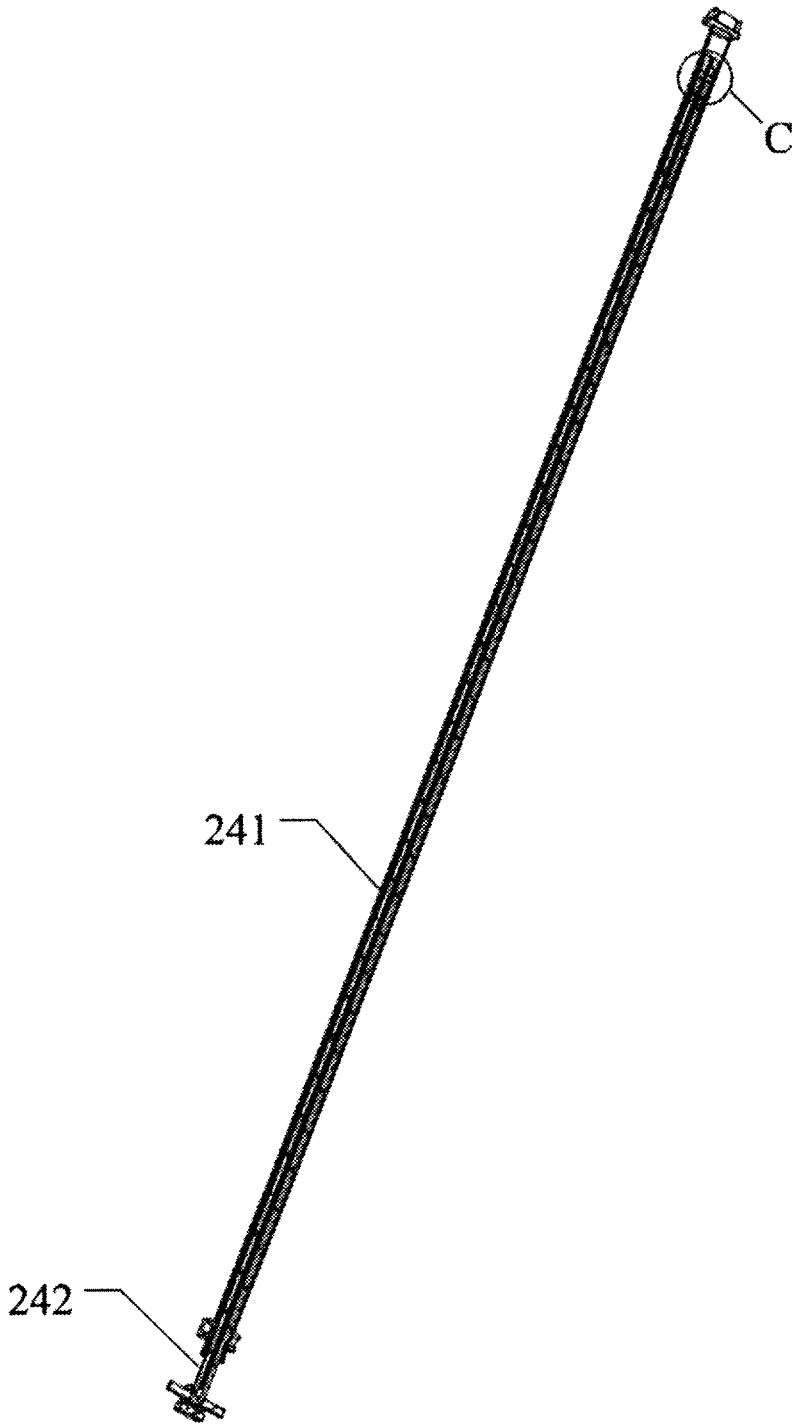
FIG. 12 denotes a structural view of the retractable cylinder of the telescopic transmission component of FIG. 5.
Figure 13:
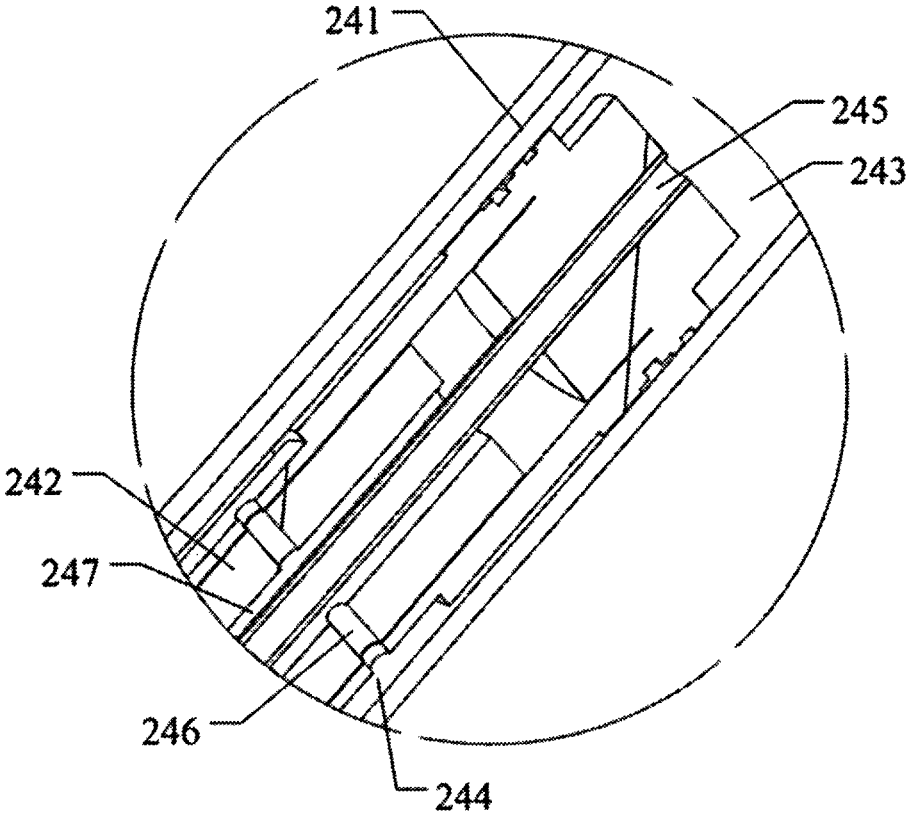
FIG. 13 shows a partially enlarged view of portion C of FIG. 12.

As shown in FIGS. 9-10, an inner cavity of the cylinder barrel 241 of the telescopic cylinder 24 is separated to form a rod chamber 244 and a non-rod chamber 243 by telescopic rod 242. In other words, partial space of the inner cavity of the barrel 241 overlaps the telescopic rod 242 and thus forms the rod chamber 244. Partial space of the inner cavity of the barrel 241 doesn't overlap the rod 242 and locates at right side (See FIG. 10) of a distal end of the telescopic rod 242, and accordingly, forms the non-rod chamber 243. The hollow arrangement 247 of the telescopic rod 242 communicates with the rod chamber 244 via a connection path 246. The hollow arrangement 247 of the rod 242 together with the oil guiding tube 245 inside the arrangement 247 is communicated with an external oil tube.

Furthermore, one end of the rope-retracting chain 28 is attached onto the third arm 23 by means of a chain connection member 29, similarly, one end of the rope-expanding chain 27 is also attached onto the third arm 23 by means of the chain connection member 29, and the two ends are located at two sides of the chain connection member 29. By this manner, motions of the rope-expanding chain 27, rope-retracting chain 28 and third arm 23 are coordinated among each other. Alternatively, the rope-expanding chain 27 and rope-retracting chain 28 may be connected to the third arm 23 with different connective members.

Moreover, a chain detection device is provided on the rope-expanding chain 27 for real time detecting status of related chain. When a chain is broken or exceeds a predefined loose value, the chain detection device will generate alert signals to guarantee safety of the telescopic transmission component 2, and further guarantee safety of operators and other staff. In particular, the chain detection device may be disposed on the rope-expanding chain 27 at one end thereof where the chain 27 is connected to the base arm 21.

Preferably, all of the base arm 21, second arm 22 and third arm 23 are of hollow arrangement. It is noted that these arms are by no means limited to this hollow arrangement, and in fact they may be of other constructions.

Furthermore, these hollow arrangements of the base arm 21, second arm 22 and third arm 23 form a telescopic cavity into which the telescopic cylinder 24, first sprocket wheel 25, second sprocket wheel 26, rope-expanding chain 27 and rope-retracting chain 28 are received, thus leading to a compact structure for the telescopic transmission component 2, and further reducing wear and aging of the components, thereby extending lifetime. This also reduces repair and maintenance frequency and makes it more convenient to repair and maintain the same, thus decreasing related costs. In addition, to certain extent these components are not exposed outside and accordingly, risk of operators being injured due to unintentional collision with the components is also reduced. Of course, it is also feasible to place the telescopic cylinder 24, first sprocket wheel 25, second sprocket wheel 26, rope-expanding chain 27 and rope-retracting chain 28 outside the telescopic cavity (that is, place them onto the outer walls of the base arm 21, second arm 22 and third arm 23).

In a summary, as the telescopic rod 242 is secured onto the base arm 21, when driven by suitable liquid medium, the cylinder barrel 241 will move upwardly together with the second arm 22 (See orientation of figures) such that the second arm 22 will move out of the base arm 21. In turn, under the traction of the rope-expanding chain 27 and first sprocket wheel 25, the third arm 23 is pulled to move out of an upper end of the second arm 22. With continuous injection of the liquid medium into the cylinder barrel 241, the second arm 22 and third arm 23 will continue to move toward the upper end until desired travel distance or maximum predefined distance is reached. During this movement, the first sprocket wheel functions as a movable pulley, and in this situation, displacement of the third arm 23 relative to the base arm 21 is two times as long as a travel distance of the cylinder barrel 241 (the distance of the second arm 22 with respect to the base arm 21). In this case, telescopic distance is certainly extended.

When oil enters the rod chamber 244 of the cylinder barrel 241 through the hollow arrangement 247 of the telescopic rod 242, the barrel 241 will drive the second arm 22 to move together downwardly such that the second arm 22 will retract from the upper end of the base arm 21. In turn, the third arm 23 will retract into the second arm 22 when driven by the rope-retracting chain 28 and second sprocket wheel 26. With continuous oil injection into the telescopic rod 242, the second arm 22 and third arm 23 will continuously retract towards a low end until a desired retracting location or complete retracting location is reached. During this retracting, the second sprocket wheel 26 works as a movable pulley such that the displacement of the third arm 23 relative to the base arm 21 is two times as long as the travel distance of the cylinder barrel 241 (that is, the distance of the second arm 22 relative to the base arm 21).

Preferably, please refer to FIG. 1 and other related figures, the third arm 23 is hinged to the operation platform 3 by said connecting arm 5. In other words, the third arm 23 is hinged to connecting arm 5, and connecting arm 5 is connected with the operation platform 3. The connecting arm 5 helps the operation platform 3 move further along a horizontal direction. The base arm 21 is hinged to the vehicle 1 by the supporting arm 4 which is movably connected with relevant component of the vehicle 1. In addition, a luffing cylinder 6 is disposed between the third arm 23 and connecting arm 5, and another luffing cylinder 6 is disposed between the base arm 21 and supporting arm 4. By this manner, the third arm 23, connecting arm 5 and luffing cylinder 6 connected therewith together define a reliable triangle construction. Similarly, the base arm 21, supporting arm 4 and luffing cylinder 6 connected therewith also together define a reliable triangle construction. This makes sure that the aerial work platform bears more stability and security. Of course, other functional component such as that for leveling may be disposed among the third arm 23, connecting arm 5 and luffing cylinder 6, and among the base arm 21, supporting arm 4 and luffing cylinder 6.

When the aerial work platform requires extending its arms, the second and third arms 22, 23 in the telescopic transmission component 2 are controlled to extend. At this time, the operation platform 3 coupled with the telescopic transmission component will also be extended when driven by the third arm 23. At this time, relevant luffing cylinder 6, supporting arm 4 and telescopic connection component 5 are also controlled to adjust angle or location of relevant arms until the operation platform 3 moves to a predefined working location or a maximum extension distance is reached.

Similarly, when the aerial work platform requires withdrawing its arms, the second and third arms 22, 23 of the telescopic transmission component 2 are controlled to retract. At this time, the operation platform 3 coupled with the telescopic transmission component 2 will also be retracted when driven by the third arm 23. At this time, relevant luffing cylinder 6, supporting arm 4 and telescopic connection component 5 are also controlled to adjust angle or location of relevant arms until the operation platform 3 moves to a predefined working location or returns to its original location without extension.

In addition, the supporting arm 4 is connected with the turret of the vehicle 1, and the same turret is disposed on the base. The turret may not be provided with other functional elements.

In summary, according to some embodiments of the invention, relevant arms are driven by cooperation of the chain and sprocket. Connections among related components are simple and accordingly, stable, rapid and accurate transmission is realized. In addition, the chain has strong structural strength and extremely less resilient deformation. Accordingly, the telescopic transmission component features high stability, accuracy and security.

Therefore, embodiments of current invention makes it possible to manipulate with ease the aerial work platform to perform corresponding motions by an operator standing on the ground and, this kind of manipulation is quick and accurate. In addition, more convenience and human-friendliness is brought. At the same time, life time of relevant components of the aerial work platform is extended, and maintenance and repair cost is further reduced.

Though various embodiments of the present invention have been illustrated above, a person of the art will understand that, variations and improvements made upon the illustrative embodiments fall within the scope of the present invention, and the scope of the present invention is only limited by the accompanying claims and their equivalents.

The invention claimed is:

1. A vehicle with a hinged control box, comprising: a vehicle frame, a driving system disposed on the vehicle frame, and the control box; wherein the control box is hinged on a lateral side of a base of the vehicle frame; the control box is electrically connected with the driving system; a casing is disposed in the lateral side of the base; an opening is defined on a lateral side of the casing for turning the control box into and out of the casing; and an edge of the control box is hinged to an upper edge of the opening, such that the pivot axis of the door is above the opening.

2. The vehicle with the hinged control box as recited in claim 1, wherein a locking device is provided on both of the control box and casing for locking the control box when turning into the casing.

3. The vehicle with the hinged control box as recited in claim 2, wherein a hinging element for hinging the control box and casing together is provided with a supporting locking device for supporting and locating the control box.

4. An aerial work platform, comprising the vehicle with the hinged control box as recited in claim 3, a telescopic transmission component pivotably mounted on the vehicle, and an operation platform disposed on a distal end of the telescopic transmission component.

5. The aerial work platform as recited in claim 4, wherein a control device is provided on the operation platform for being electrically connected with the driving system of the vehicle.

6. An aerial work platform, comprising the vehicle with the hinged control box as recited in claim 2, a telescopic transmission component pivotably mounted on the vehicle, and an operation platform disposed on a distal end of the telescopic transmission component.

7. The aerial work platform as recited in claim 6, wherein a control device is provided on the operation platform for being electrically connected with the driving system of the vehicle.

8. An aerial work platform, comprising the vehicle with the hinged control box as recited in claim 1, a telescopic transmission component pivotably mounted on the vehicle, and an operation platform disposed on a distal end of the telescopic transmission component.

9. The aerial work platform as recited in claim 8, wherein a control device is provided on the operation platform for being electrically connected with the driving system of the vehicle.

* * * * *